United States Patent [19]

Brown

[11] 4,018,163

[45] Apr. 19, 1977

[54] PLACEMENT METHOD FOR Q.D. CHARGES USING MINIMUM DIVING TIME

[75] Inventor: Claude H. Brown, Arlington, Tex.

[73] Assignee: Jet Research Center, Inc., Arlington, Tex.

[22] Filed: Jan. 30, 1976

[21] Appl. No.: 653,985

Related U.S. Application Data

[62] Division of Ser. No. 522,542, Nov. 11, 1974, Pat. No. 3,972,285.

[52] U.S. Cl. ..... 102/23

[51] Int. Cl.[2] ..... F42D 1/00

[58] Field of Search ..... 102/22–24, 102/24 HC

[56] References Cited

UNITED STATES PATENTS 2,898,085 8/1959 Borins et al. ..... 102/24 HC

*Primary Examiner*—Verlin R. Pendegrass

*Attorney, Agent, or Firm*—Bruce E. Burdick; Thomas R. Weaver; John H. Tregoning

[57] ABSTRACT

An apparatus for the simultaneous placement of a plurality of objects on a substantially horizontal surface is disclosed, said apparatus comprising a platform to position the objects, release mechanisms to releasably attach the objects to the platform and a system for simultaneous release of the objects.

3 Claims, 8 Drawing Figures

PLACEMENT METHOD FOR Q.D. CHARGES USING MINIMUM DIVING TIME

Figure 1:
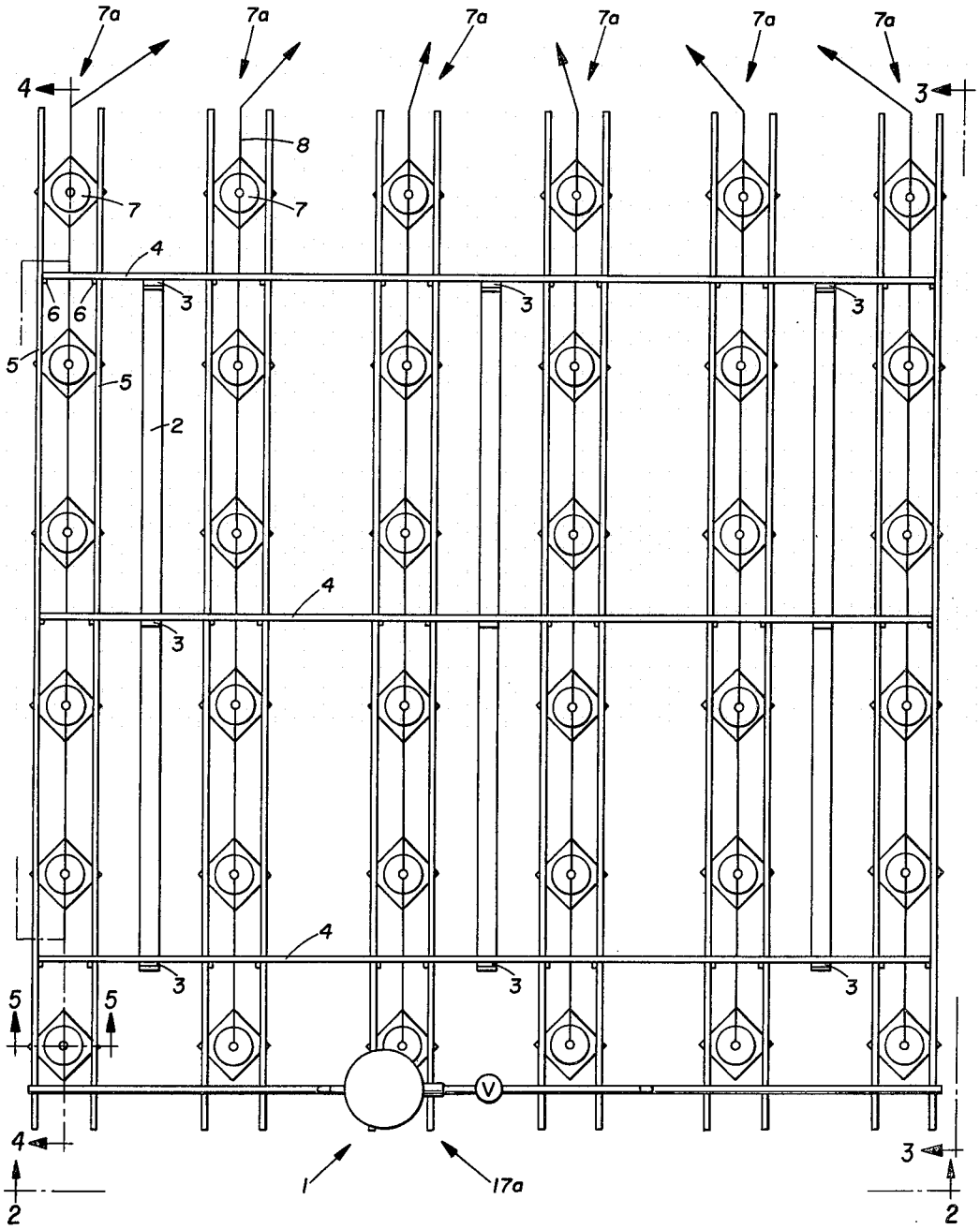

This is a division of application Ser. No. 522,542 filed Nov. 11, 1974 now U.S. Pat No. 3972.285

This invention relates to material handling, and further relates to the placement of solid objects in predetermined patterns. This invention still further relates to a reusable platform for the simultaneous placement of solid objects in predetermined patterns and to the mechanism by which such platform is made reusable.

The placement of solid objects in a predetermined pattern, hereinafter referred to as an array, is desirable for many purposes, among such purposes being the positioning of shaped explosive charges for explosive excavation as described in U.S. Pat. No. 3,348,482, wherein an array of shaped explosive charges is described as useful to form ditches and trenches, and to remove overburden to expose an area for mining.

One particularly advantageous and well known use of an array of shaped explosive charges resides in the formation of underwater trenches such as are required in the laying of underwater pipelines. However, manual placement of shaped explosive charges by underwater divers is time-consuming and difficult. Manual placement is particularly difficult in deep, cold or turbulent waters where diving time can be severely shortened.

One solution of the underwater charge placement problem is disclosed in U.S. Pat. No. 3,741,119, wherein a framework having explosive charges permanently affixed thereto is utilized. The framework permits above water prepositioning of explosive charges followed by underwater placement of the framework containing the entire array of charges, at one time in one step. The problem with this solution is that even a simple ditching operation requires the construction of a new framework for each array placed; the framework is not reusable since it is destroyed by the exploding charges permanently affixed to it. When laying a pipeline for a great distance to an offshore location many such frameworks would be needed. Thus, the art has a need for a reusable underwater charge placement apparatus.

A reusable framework by itself does not provide the answers to other technical problems in the underwater placement of arrays of explosive charges. The ability to replace individual charges within an array without replacing all charges is desirable. This is desirable, for example, where an individual charge is damaged while the remaining charges are unharmed, since the effectiveness of the array of shaped charges depends on the interaction of those charges. This problem makes it useful and desirable that a means for single replacement of charges held by the framework be made possible. A solution to these and other problems is provided by the apparatus of this invention.

This invention provides an apparatus for placement of objects in an array, which apparatus comprises a reusable framework having attached thereto a plurality of release mechanisms and a power manifold to initiate operation of the release mechanism.

Figure 2:
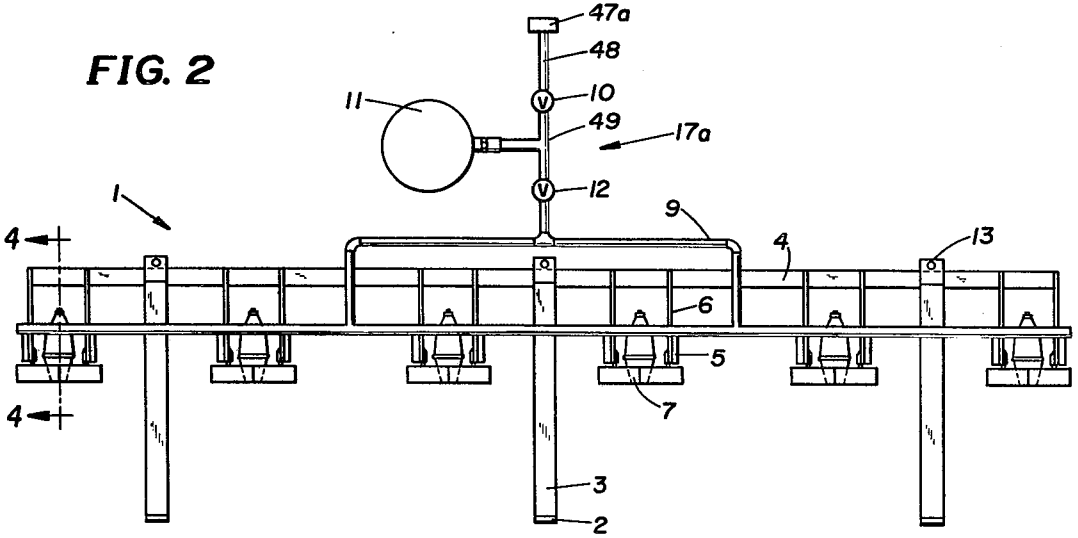
Figure 3:
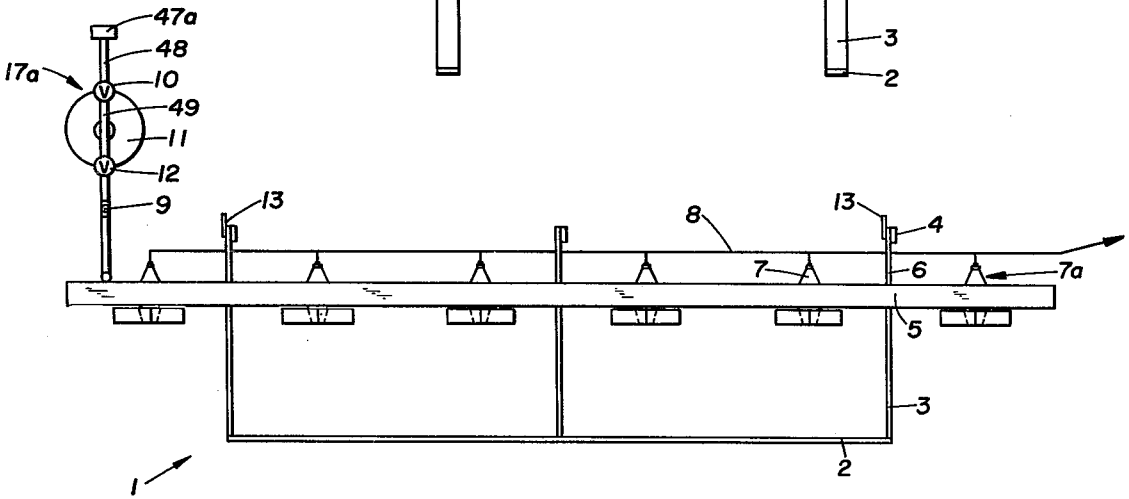
Figure 4:
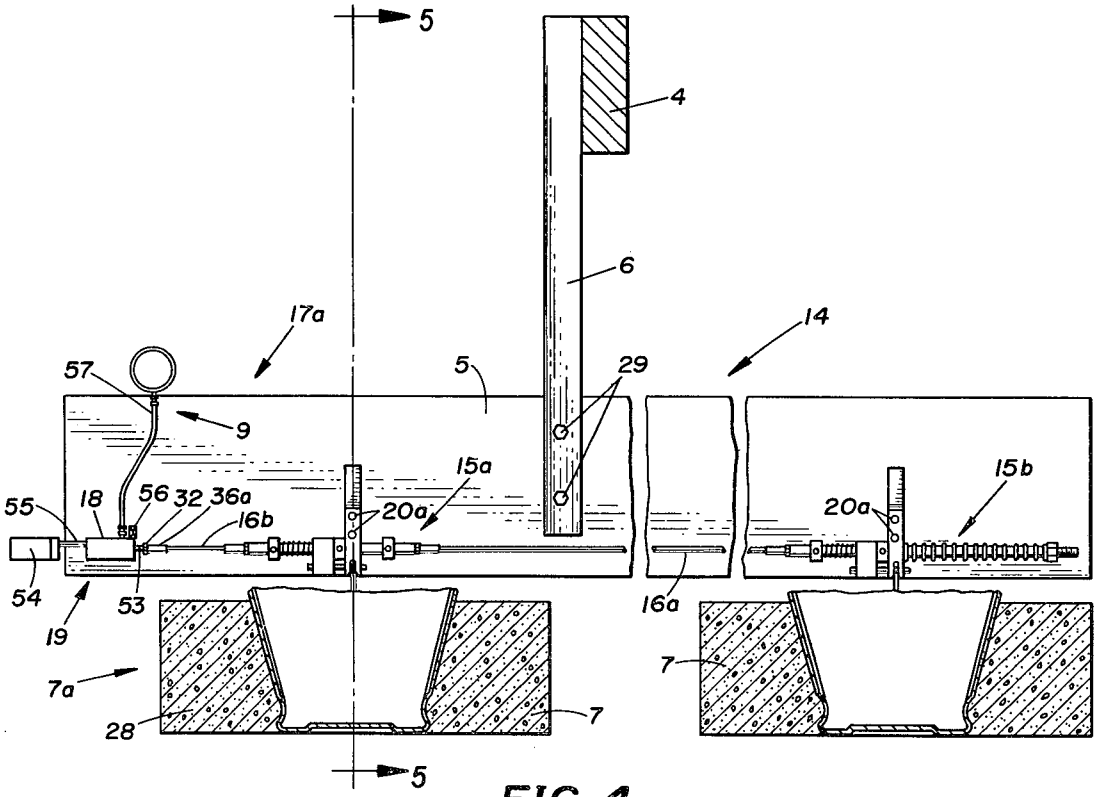
Figure 5:
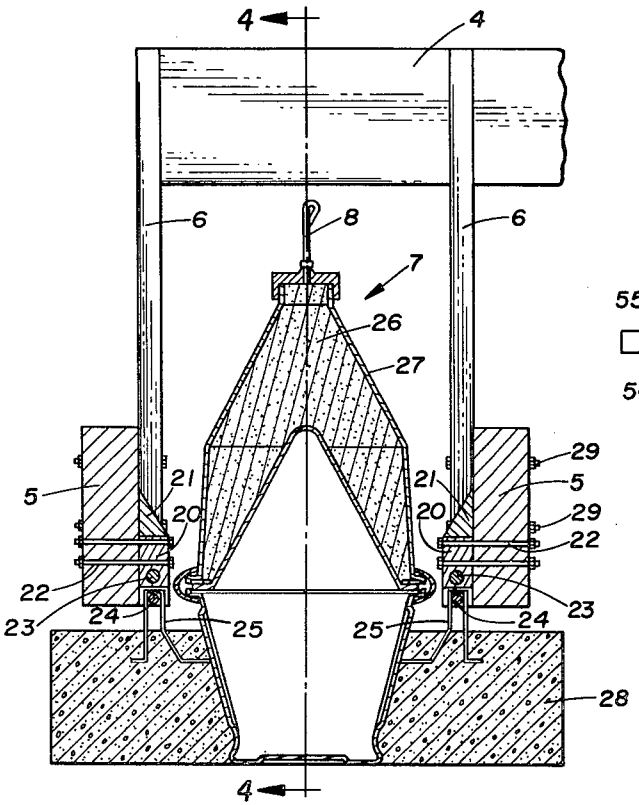
Figure 6:
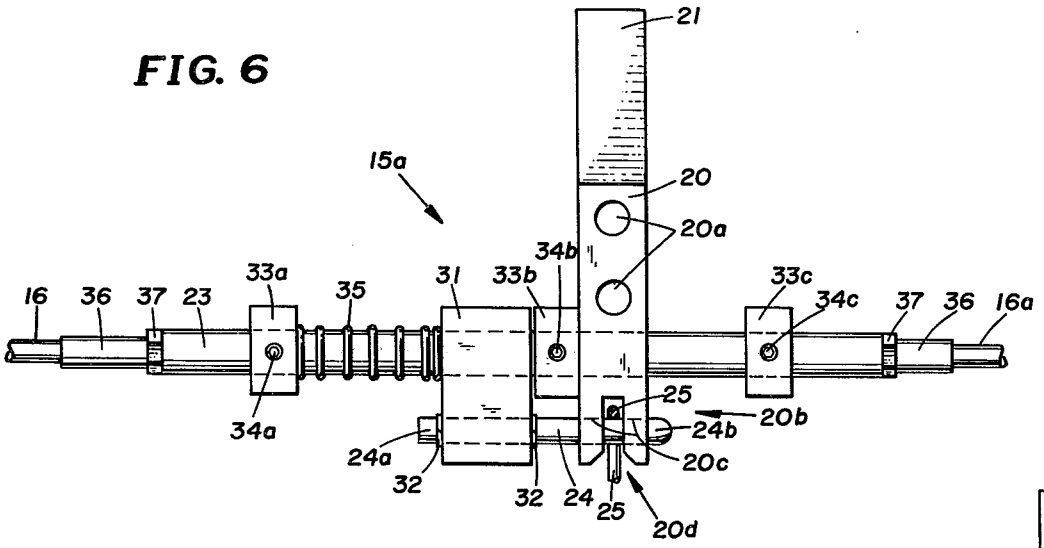
Figure 7:
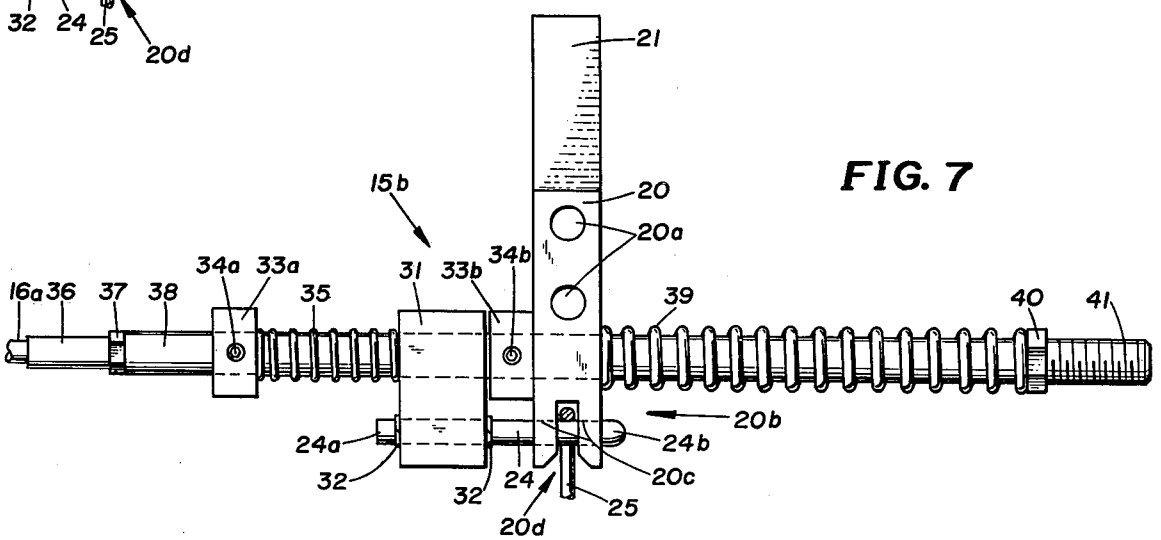

The apparatus of this invention is more fully described in the attached drawings which include:

FIG. 1, a top plan view of a framework for positioning objects in an array;

FIG. 2, a front elevational view of the framework of FIG. 1;

FIG. 3, a side elevational view of the framework of FIGS. 1 and 2;

FIG. 4, a cross-sectional view taken along line 4—4 of FIG. 1 showing a release mechanism;

FIG. 5, a cross-sectional view taken along line 5—5 of FIG. 1 showing an object attached to the framework of FIG. 1 and its means of attachment;

FIG. 6, a detail view of a first release appliance;

FIG. 7, a detail view of a second release appliance; and

Figure 8:
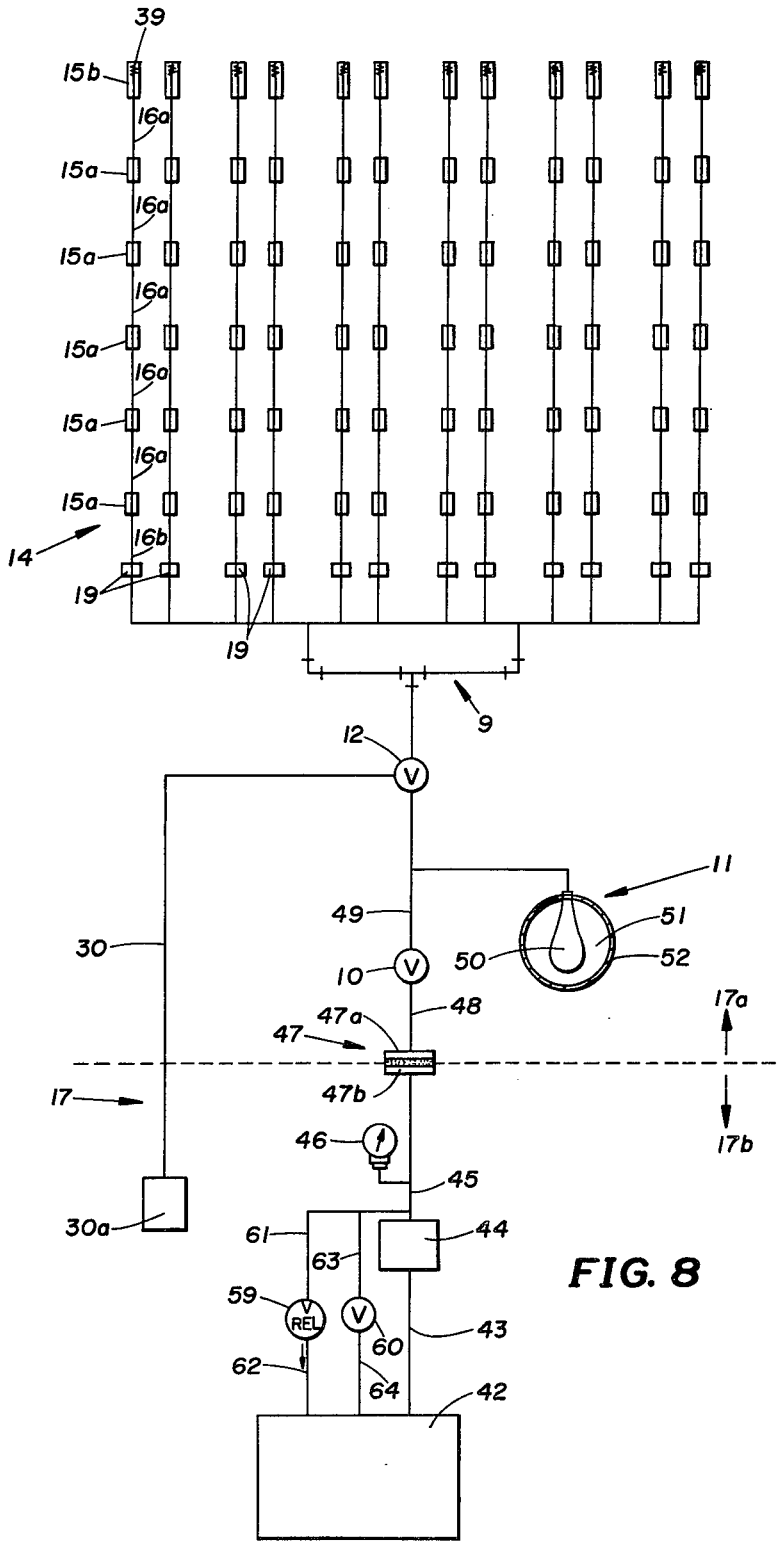

FIG. 8, a schematic diagram of a system for actuating the release mechanisms.

FIG. 1 is a top plan view of reusable framework 1 including three shoe members 2 each attached to three post members 3 which are attached to and space three cross members 4. Six pairs of substantially parallel support rails 5 are attached to and spaced by eighteen pairs of hanger bars 6, and hangar bars 6 are spaced along and attached to cross members 4. Six rows 7*a* of objects 7 are shown attached to and spaced between pairs of support rails 5, each such row 7*a* containing six objects 7 connected by a connecting member 8. The attachment of objects 7 to support rails 5 is shown in detail in FIGS. 4, 5, 6 and 7. Also shown in FIG. 1 is the framework supported portion 17a of actuating system 17 (not shown). Portion 17*a* is described in detail in FIGS. 2 and 8.

FIG. 2 is a front elevational view of framework 1 showing three shoe members 2 attached to and supporting three post members 3 which are attached to and support a cross member 4. Support rails 5 are shown attached to, supported by and spaced along a cross member 4 by pairs of hanger bars 6. Also shown in FIG. 2 is the framework supported portion 17a of actuating system 17 (not shown). Portion 17a includes union half 47a connected by conduit 48 to pressurization valve 10. Valve 10 is connected by tee adapter 49 to valve 12 and accumulator 11. Accumulator 11 is shown in greater detail in FIG. 8. Valve 12 is connected by manifold 9 to six pairs of fluid mechanical transducers 19 (not shown). Transducers 19 are shown in detail in FIGS. 4 and 8. Also shown in FIG. 2 are attachment blocks 13 for attachment of framework moving means (not shown).

FIG. 3 is a side elevational view of framework 1 showing a shoe member 2 attached to and supporting three post members 3 which are attached to, space and support three cross members 4. A support rail 5 is shown attached to and supported by hanger bars 6 which are attached to and supported by cross members 4. A row 7*a*, of six objects 7, is shown attached to, spaced along and supported by support rail 5. The six objects 7 are shown connected by a connecting member 8. Also shown in FIG. 3 is the framework supported portion 17*a* of actuating system 17 (not shown). Portion 17a includes union half 47*a* connected by conduit 48 to pressurization valve 10. Valve 10 is connected by tee adapter 49 to valve 12 and accumulator 11. Accumulator 11 is shown in greater detail in FIG. 8. Valve 12 is connected by manifold 9 to six pairs of fluid mechanical transducers 19 (not shown). Transducers 19 and manifold 9 are shown in detail in FIGS. 4 and 8. Also shown in FIG. 3 are attachment blocks 13 for attachment of framework moving means (not shown).

FIG. 4 is a view along line 4—4 of FIGS. 1 and 2, and shows generally a release mechanism 14 used to release one side of a row 7*a* of objects 7 and the framework supported portion 17*a* of an actuation system 17 (not shown) used to initiate the release. Two objects 7 are shown in cut-away cross section in order to expose release mechanism 14. The middle four objects 7 in the row 7*a* of the six objects 7 along line 4—4 of FIGS. 1 and 2 are not shown.

Release mechanism 14 is attached to a support rail 5 by bolts 22 (not shown) passing through boltholes 20*a*. Support rail 5 is in turn connected by bolts 29 to a hanger bar 6 and hanger bar 6 is connected to and supported by cross member 4. Release mechanism 14 must comprise at least one release appliance 15*b* and one flexible cable 16*b*. As shown in FIG. 4, each release mechanism 14 includes one release appliance 15*b* which is connected by a series of five flexible cables 16*a*, only one of which is shown, to a series of five release appliances 15*a*, only one of which is shown, and a flexible cable 16*b*. The release appliance 15*a* shown is connected to fluid mechanical tranducer 19 by flexible cable 16*b* held by a swage fitting 36*a* attached to piston 53 and secured by a jamb nut 32. Flexible cables 16*a* and 16*b* canbe replaced by any other tension movable connector (e.g., rope, rod, string, bar, timber, etc. ) of sufficient tensile strength.

The framework supported portion 17*a* of the actuation system shown includes a fluid mechanical transducer 19 having a piston 53 and cylinder 18. Cylinder 18 is connected to surge chamber 54 by conduit 55 and to bleeder valve 56. Fluid mechanical transducer 19 is also connected to manifold 9 by conduit 57. Release appliances 15a and 15b are shown in greater detail in FIGS. 6 and 7.

FIG. 5 is a cross-sectional view along line 5—5 of FIG. 1 and line 5—5 of FIG. 4 showing the attachment of an object 7 to a pair of support rails 5 of the framework of FIG. 1. A pair of support rails 5 are shown attached to a pair of hanger bars 6, and hanger bars 6 are, in turn, attached to, supported by, and spaced along crossmember 4. A pair of release mechanisms 15a (not shown), which are attached to a pair of support rails 5 by bolts 22, include drive shafts 23 and slide pins 24, both shown slidably and peripherally supported by mounting blocks 20, having tapered portions 21. Hooks 25, which can also be loops, bars, ledges or other other suitable attachment means connected to each object 7 are shown resting on slide pins 24. As shown, object 7 comprises a shaped explosive charge 26 inside a cannister 27 which has been imbedded in a concrete weight 28 of sufficient density to give object 7 negative buoyancy when released in a buoyant medium, such as salt water. It will be understood that the invention is not restricted to use with shaped explosive charges but can be utilized for placement of seedlings, bottles, mail parcels, underwater mines or a diverse multitude of other objects which can be advantageously placed in an array.

FIG. 6 is a detail view of a first release appliance 15a. A mounting block 20 is shown with tapered portion 21 and boltholes 20a for bolts 22 (shown in FIG. 5). Mounting block 20 slidably and peripherally holds both a drive shaft 23 and a slide pin 24. Mounting block 20 has a slotted end 20*b* having a slot 20*d* into which a hook 25 can fit while being supported by slide pin 24 which is attached to a sliding block 31. Sliding block 31 is mounted slidably on drive shaft 23. One end 24*a* of slide pin 24 is securely positioned in sliding block 31 by jamb nuts 32 while the other end 24*b* of slide pin 24 projects from sliding block 31 so as to pass through slide holes 20c in the slotted end 20*b* of mounting block 20.

Drive shaft 23 has peripherally mounted thereon, in order, a stop collar 33a held in place by a set screw 34*a*, a spring 35, a sliding block 31 holding slide pin 24, stop collar 33*b* held in place by set screw 34*b* and as stop collar 33*c* held in place by a set screw 34*b* and a stop collar 33*c* held in place by a set screw 34*c*. Drive shaft 23 is shown connected to a flexible cable 16 by a swage fitting 36 secured by jamb nut 37.

FIG. 7 is a detail view of a second release appliance 15*b* in the closed position. A mounting block 20 is shown with tapered portion 21 and boltholes 20*a* for bolts 22 as shown in FIG. 5. Mounting block 20 slidably and peripherally holds both a drive shaft 38 and a slide pin 24. Mounting block 20 has a slotted end 20*b* having a slot 20d into which a hook 25 can fit while being supported by slide pin 24 which is attached to a sliding block 31. Sliding block 31 is mounted slidably on a drive shaft 38. One end 24a of slide pin 24 is positioned in sliding block 31 by jamb nuts 32, while the other end 24*b* of sliding pin 24 projects form sliding block 31 so as to pass through slide holes 20c in the slotted end 20*b* of mounting block 20.

Peripherally mounted on drive shaft 38 are, in order, a stop collar 33a held in place by a set screw 34a, a spring 35, a sliding block 31 containing slide pin 24, a stop collar 33b held in place by set screw 34*b*, mounting block 20, and spring 39 held in place by nut 40 threadly attached to threads 41 on drive shaft 38. Attached to one end of drive shaft 38 is flexible cable 16*a* held by swage fitting 36 which is in turn attached to drive shaft 38 and held in place by jamb nut 37.

FIG. 8 is a schematic diagram of an actuating system 17, a hydraulic triggering system, showing remotely supported portion 17*b* including fluid reservoir 42 connected by conduit 43 to pump 44 which is in turn connected by conduit 45 to both pressure gage 46 and union portion 47*b*. Portion 17*b* can also include pressure relief valve 59 connected to conduit 45 by conduit 61 and to reservoir 42 by conduit 62. Portion 17*b* can additionally include a dump valve 60 connected to conduit 61 by conduit 63, and to reservoir 42 by conduit 64. Also shown is framework supported portion 17*a* including union portion 47a connected by conduit 48 to pressurization valve 10 which is connected by tee adapter 49 to release valve 12 and accumulator 11. Accumulator 11 can include bladder 50 surrounded by gas 51 within cylinder wall 52. Release valve 12 is connected by communication means 30 to remote release signal generator 30*a*. Valve 12 is also connected by manifold 9 to six pairs of fluid mechanical transducers 19, as shown in FIG. 4 which are in turn each connected to six pairs of release mechanisms 14.

It will be appreciated by those skilled in the art that the size, position and quantity of the various components of framework 1 are not fixed, but can vary as the size , position and quantity of objects 7 vary. Thirty-six (36) objects, seventy-two (72) release appliances, and seventy-two (72) flexible cables are shown in the preferred embodiment but this invention only requires one object, one release appliance, and one flexible cable or other means for moving the drive shaft of that one release appliance.

For placement of objects in an array only two objects would be required, since that is the minimum number of objects which constitute an array. Therefore only two release appliances, two objects and two pulling means are required for placement of objects in an array. It will be understood that the pulling means can be one or more mechanical transducers, preferably fluid-mechanical transducers, but could be any transducer capable of converting a release signal into mechanical movement to release the objects. Although the preferred embodiment shows each object 7 as being supported by a pair of release mechanisms, each object 7 could be supported by a single release mechanism without departing from this invention.

It will be appreciated by those skilled in the art that release appliances 15a are optional because release appliances 15a can be replaced by release appliances 15b since release appliances 15b can contain all the features of 15a, but each has in addition a spring 39 for biasing the drive shaft 38 toward the closed position. It will be appreciated that although release appliances 15b are shown as being connected to flexible cable on one end only that release appliances 15b could be connected on both ends to flexible cable when used to replace release appliances 15a. Although flexible cable is used in the preferred embodiment to connect release appliances 15a, and mechanical transducer 19, it will be appreciated that many other flexible or non-flexible connecting members could be substituted without departing from the invention. Similarly, many other changes could be made to the preferred embodiment without departing from the present invention.

OPERATION

The operation of my invention can be described with reference to FIGS. 1-8. First, the overall operation of the invention will be described briefly and then the individual steps in the operation will be described in detail. This operation will be described with respect to a particular preferred embodiment wherein objects 7 are shaped explosive charges and these charges are used to excavate an underwater trench in an ocean floor.

Referring to FIGS. 1, 2 and 3, framework 1 is assembled as previously described. This assembly would preferably occur on land, as will be more particularly described below. This assembly would preferably include attachment of the framework supported portion 17*a* of actuating system 17 to the framework 1, as previously described. Remote portion 17*b* of actuating system 17 is assembled on a barge or boat. Assembled framework 1 is then transferred, in the manner below described, to the barge or boat. The charges 7 can be individually loaded, as below described, into framework 1 after assembly of framework 1. This loading can occur on land or on the barge. The barge is then moved to a predetermined location. The loading of the charges can be accomplished during the movement of the barge, if desired. After the barge reaches the predetermined location, remotedly supported portion 17*b* and framework supported portion 17*a* are connected, as below described, and remote release signal generator 30a is connected to release valve 12 by communication means 30.

The actuating system 17 is then readied for actuation in the manner below described. After actuating system 17 is readied for actuation, framework supported portion 17*a* is safely disconnected from remotedly supported portion 17*b*, in the manner below described. After such disconnection, framework 1, with portion 17a attached thereto, is lowered to a predetermined position on the ocean floor where release of the charges is to occur and remains there until retrieved, as below described. While framework 1 is in position on the ocean floor remote release signal generator 30*a* is caused to signal release valve 12 by way of communication means 30. Release valve 12 opens, causing release of the charges in a manner below described. After this release of the charges has occurred, framework 1 is retrieved, in a manner below described, and placed on the barge or boat once again, leaving the charges in place on the ocean floor. The barge is then moved a safe distance away from the charges. The charges can then be detonated to form a trench in the ocean floor, such detonation occurring in the manner below described. Retrieved framework 1 may be reloaded with new charges, as below described. After reloading, the portion 17a may be readied again and the framework 1 relowered to a new predetermined position on the ocean floor and these new charges released and detonated to further extend the trench. By further repeating the above procedure an ocean floor trench can be rapidly excavated.

The transfer of framework 1 onto the barge or boat can be accomplished by a lifting crane mounted on the barge or boat, said crane having a haul rope attachable to attachment blocks 13 of framework 1. Upon lifting framework 1, the crane could lower framework 1 onto a barge or boat. Other cranes of varied designs could also be used.

The loading of objects 7 onto framework 1 will be descibed next, with particular reference to FIGS. 6 and 7. Release appliances 15*a* and 15*b* have a single loading feature. This single loading feature allows loading by a single person during transit of the barge or boat since position of the barge or boat is irrelevant to this loading operation. The single loading feature also allows the crew to reload the framework after each detonation without having to use elaborate equipment for simultaneous loading.

The actual loading operation will now be described with reference to FIG. 7. Sliding block 31 is moved toward stop collar 33a and away from mounting block 20 and stop collar 33b, compressing spring 35 and moving slide pin end 24*b* out of slot 20*d*. Hook 25 of object 7 is then placed into slot 20d. Sliding block 31 is then released, allowing spring 35 to expand and move sliding block 31 toward mounting block 20, moving slide pin end 24*b* through slot 20d and under hook 25. This movement of sliding block 31 is then repeated on the other one of the pair of release appliances preferably used to support each object 7. Object 7 will then be supported by hooks 25 resting on slide pin ends 24b and retained within slots 20d of mounting blocks 20. This movement of sliding block 31 is then performed on each release appliance to which it is desired to attach an object. The loading operation is thus completed and the objects are securely but releasably attached to their respective release appliances, thus permitting movement of framework 1 without the objects 7 being prematurely dropped.

Referring now to FIG. 8, the connection of portions 17*a* and 17*b* of actuating system 17 will be described. Framework supported portion 17*a* is connected to remotely supported portion 17*b* by means of joining union half 47*a* of portion 17 *a* to union half 47b of portion 17b. Also remote release signal generator 30a is connected, by communication means 30, to release valve 12. These connections can be made during transit of the barge or boat to the predetermined detonation site or after the barge or boat arrives at the detonation site, since the position of the barge boat is irrelevant to this connection operation. Once portions 17a and 17b have been connected, the readying operation may be accomplished.

Referring to FIGS. 4 and 8, the readying operation will be described. Valves 10 and 12 are opened, valve 60 is closed and pump 44 turned on, thereby causing flow of liquid from reservoir 42 through conduit 43, pump 44, conduit 45, union 47, conduit 48, pressurization valve 10, tee adapter 49, valve 12, manifold 9 and conduit 57 into mechanical transducers 19. Bleeder valves 56 can be opened to allow trapped air to escape from transducers 19, thereby assuring a "liquid-full"actuating system 17 and a "liquid-full" transducer 19. Once system 17 becomes liquid-full, pressure begins to build up in system 17 due to the continued flow of liquid caused by operation of pump 44, so release valve 12 is closed as soon as an increase occurs in the reading of pressure gage 46, thereby isolating manifold 9 and transducers 19 from any further pressure increase due to pump 44. The pumped liquid then enters bladder 50 thus causing pressure to build up in the portion of athe actuating system 17 between pump 44 and now closed release valve 12, this pressure acts to further compress the pressurized gas 51 held in accumulator 11, exterior of bladder 50 and interior of wall 52. Accumulator 11 thus stores pressurized liquid by means of an expandable bladder 50 within a pressurized gas 51 contained by wall 52. The expansion of gas 51 later causes movement of pistons 53, as described below. When a given pressure is reached, as determined by pressure gage 46, valve 10 is manually closed to isolate the now pressurized accumulator 11, although an automatic closing could be provided without departing from my invention. Should pressure gage 46 malfunction or excessive pressure otherwise develop between pump 44 and valve 10, pressure relief valve 59 will open to allow excess pressure to escape until pump 44 can be stopped. After valve 10 is closed pump 44 is stopped, by either automatic or manual means, to prevent any further pressure buildup. A dump valve 60 can also be provided to allow bleeding of fluid from the portion of actuating system **17*a* and 17*b* between now closed valve 10 and pump 44 so as to allow for rapid reduction of the fluid pressure therein to allow safe disconnection of union half 47*a* from union half 47*b*. Union half 47*a* is then disconnected from union half 47*b*, so as to separate remotely supported portion 17b from framework supported portion 17a**.

Referring to FIGS. 2 and 8, once portion 17a is separated from 17b after having loaded framework 1 and readied portion 17a, as described above, framework 1 is lowered from the barge or boat to a desired position on the ocean floor by means of attachment blocks 13. A crane and haul rope can be used for this lowering operation, and preferably this can be the same crane as used to transfer framework 1 from land to the barge or boat, as above described, so that framework 1 need not be detached from the haul rope of a transfer crane and attached to a different haul rope of a different lowering crane. This lowering operation can preferably utilize guidance means to assure proper positioning of framework 1 on the ocean floor. Since framework 1 is retrievable and intended to be reused as desired, such guidance means could be placed in whole or in part upon framework 1, so long as the guidance means was of such design as to not interfere with the release or fall of objects 7 from framework 1, as below described.

Referring to FIGS. 4, 6, 7 and 8, the release of objects 7 from framework 1 will be described. Remote release signal generator **30*a* is activated to communicate a release signal to release valve 12 via communication means 30. Upon receiving this release signal, valve 12 opens, allowing a portion of the pressurized liquid accumulated in accumulator 11 to enter tee adaptor 49 and thus force fluid into mechanical transducers 19. This fluid is more specifically forced out of bladder 50 by the expansion of gas 51 in cylinder 52 of accumulator 11 and this fluid thus enters tee adaptor 49 and forces fluid out of conduit 57 and into mechanical transducer 19. When this pressurized liquid enters mechanical transducers 19 the pressure of the liquid acts upon pistons 53 therein to produce movement of pistons 53 away from objects 7. This movement of pistons 53, to the left as shown in FIG. 4, causes movement of flexible cables 16b to the left, since cables 16b are attached to piston rod 53, The movement of cables 16b causes movement of all drive shafts 23 and 38 attached directly or indirectly to said cables 16*b*. Looking to FIG. 7, it is seen that movement, to the left as shown, of drive shaft 38 causes movement of stop collar 33*b* to the left (i.e., toward transducer 19). This movement of stop collar 33b necessarily results in movement of sliding block 31 toward the left, since sliding block 31 abuts the left side of stop collar 33*b*. The resultant movement of sliding block 31 to the left causes slide pin 24 to move out of slide holes 20c in the slotted end 20*b* of mounting block 20, thereby opening slot 20d to allow hook 25 to fall from slot 20*d*. Spring 35 serves, in part, to keep sliding block 31 against stop collar 33b unitil this movement occurs. Hook 25, being attached to object 7 is, in fact, pulled from 20d by the weight of object 7. Object 7 may be provided with extra concrete weight 28 or other weights to facilitate dropping in a liquid environment such as water. Spring 39 is compressed against mounting block 20 by nut 40 during the release movement of drive shaft 38, and thus limits that movement to the amount of compression which will result in full compression of spring 39. It will be understood that release appliance 15*a* releases in the same manner, except that the release movement of drive shaft 23 is limited by a stop collar 33c rather than a spring 39 as with drive shaft 38. It will be understood by those of ordinary skill in the art that the movement of drive shafts 23 and 38 could be reversed relative to framework 1 by putting springs 39 between transducers 19 and the first release appliances and reversing the position of the parts of release appliances 15*a* and 15*b* so that slide pins 24 enter slide holes 20*c* from the right side. This can be illustrated by holding FIGS. 6 and 7 up to a mirror and viewing the mirror image. In such an instance mechanical transducers 19 would be modified to have pistons 53 move to the right in FIG. 4** rather than to the left. Many other similar modifications could be made to the apparatus without departing from the invention.

Upon completion of this release operation, the haul rope is pulled to lift framework 1 from the ocean floor, and the crane rotated to place framework on the barge or boat. The barge or boat can then be moved a safe distance away from the charges and the charges detonated via detonating cord 8. The framework 1 can be depressurized by attaching union halves **47*a* and 47*b* together again and opening valves 10 and 60 to allow the pressurized fluid to return to the reservoir 42. Once this is done, spring 39 will expand to move slide pins 24** toward slide holes 20*c* and move stop collars 33*a* and 33*b* toward their original position. An automatic alignment device could be provided to facilitate the movements of slide pins 24, although manual single reloading will necessarily involve such alignment. The loading operation can then be sepeated and then the readying operation, etc. to prepare framework 1 for reuse. Framework 1 is then relowered to a second position on the ocean floor to continue the trenching operation by dropping charges in a new location. Following this second release of charges, framework 1 can be raised and reloaded and relowered as necessary until the trench is fully completed.

Since the charges fall from framework 1 of the present invention when released, detonating cord 8 must be placed below and free from all framework members, so that framework 1 can be raised and retrieved without disturbing the position of the charges or detonating cord 8.

While the invention has been described in terms of a single preferred embodiment, many modifications of that embodiment will suggest themselves to one skilled in the art. The apparatus of the invention, while especially suited for use in positioning explosive charges in underwater trenching operations, is not in anyway limited thereto but could be readily adapted for use in releasing many other objects. The array of six rows of six objects is not essential, but is only chosen as an illustrative example, since the example must depict some number of objects. Arrays of varying numbers per rows and rows per array may be utilized by simply varying the quantity of the various components of the apparatus described. Thus, it is my intention that the following claims encompass the broad range of equivalents to which they are entitled.

What is claimed is:

1. A method of detonating an array of explosive charges using a framework, which comprises the steps of:

a. individually loading each of a plurality of explosive charges on a framework so as to form an array of the objects;
b. placing said loaded framework at a given location;
c. simultaneously releasing said array of explosive charges from said framework;
d. recovering said framework; and
e. thereafter detonating said explosive charges.

2. The method of claim 1, which further comprises the steps of:

f. repeating steps (*a*) through (*e*).

3. The method of claim 1, wherein: said step (c) of releasing includes the steps of:

i. remotely signaling an energy pulse generator;
ii. generating an energy pulse in response to said signal; and
iii. releasing said array of objects in response to said energy pulse.

* * * * *